US010256029B2

(12) United States Patent
Onozaki et al.

(10) Patent No.: US 10,256,029 B2
(45) Date of Patent: Apr. 9, 2019

(54) ELECTRONIC COMPONENT AND METHOD FOR MANUFACTURING THE SAME

(71) Applicant: MURATA MANUFACTURING CO., LTD., Kyoto-fu (JP)

(72) Inventors: Norimichi Onozaki, Nagaokakyo (JP); Kaoru Tachibana, Nagaokakyo (JP); Mitsuru Odahara, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/095,425

(22) Filed: Apr. 11, 2016

(65) Prior Publication Data

US 2016/0314891 A1 Oct. 27, 2016

(30) Foreign Application Priority Data

Apr. 27, 2015 (JP) ..... 2015-090710

(51) Int. Cl.
*H01F 5/00* (2006.01)
*H01F 27/28* (2006.01)
(Continued)

(52) U.S. Cl.
CPC ..... *H01F 27/2804* (2013.01); *H01F 41/0233* (2013.01); *H01F 41/041* (2013.01); *H01F 2027/2809* (2013.01)

(58) Field of Classification Search
CPC ..... H01F 27/2804; H01F 27/29; H01F 27/28; H01F 27/24; H01F 27/245; H01F 27/255;
(Continued)

(56) References Cited

U.S. PATENT DOCUMENTS

2009/0085711 A1* 4/2009 Iwasaki ..... H01F 17/0013 336/234
2010/0201473 A1 8/2010 Konoue et al.
(Continued)

FOREIGN PATENT DOCUMENTS

CN 101952911 A 1/2011
CN 103814419 A 5/2014
(Continued)

OTHER PUBLICATIONS

An Office Action; "Notice of Preliminary Rejection," issued by the Korean Patent Office dated Jun. 21, 2017, which corresponds to Korean Patent Application No. 10-2016-0046325 and is related to U.S. Appl. No. 15/095,425; with English language translation.
(Continued)

*Primary Examiner* — Mang Tin Bik Lian
(74) *Attorney, Agent, or Firm* — Studebaker & Brackett PC

(57) ABSTRACT

An electronic component includes a multilayer body having a configuration, in which a plurality of insulator layers containing ferrite ceramic are stacked, and a coil having a configuration, in which a plurality of coil conductor layers containing Ag and being disposed on the insulator layers are connected to at least one via hole conductor penetrating the insulator layers in the stacking direction, and having a spiral shape spiraling in the stacking direction. A first pore area ratio of a side gap interposed between an outer circumferential edge of an annular track formed by stacking the plurality of coil conductor layers and an outer edge of the multilayer body, when viewed in the stacking direction, is 9.0% or more and 20.0% or less, and the second pore area ratio of a portion interposed between two coil conductor layers in the stacking direction is 8.0% or less.

15 Claims, 10 Drawing Sheets

(51) Int. Cl.
*H01F 41/04* (2006.01)
*H01F 41/02* (2006.01)

(58) Field of Classification Search
CPC ..... H01F 27/292; H01F 2027/2809; H01F 41/041; H01F 41/0233; H01F 3/08; H01F 17/0013
USPC ..... 336/200, 233, 192, 223
See application file for complete search history.

(56) References Cited

U.S. PATENT DOCUMENTS

| | | | | |
|---|---|---|---|---|
| 2011/0037557 | A1* | 2/2011 | Konoue | H01F 17/0013 336/200 |
| 2014/0054514 | A1* | 2/2014 | Kim | H01B 1/02 252/513 |
| 2014/0191838 | A1* | 7/2014 | Yoshida | H01F 17/0013 336/200 |
| 2015/0109088 | A1* | 4/2015 | Kim | H01F 41/12 336/200 |

FOREIGN PATENT DOCUMENTS

| | | | |
|---|---|---|---|
| JP | 2004-178866 | A | 6/2004 |
| JP | 2005-005408 | A | 1/2005 |
| JP | 2005-093707 | A | 4/2005 |
| JP | 2005-159056 | A | 6/2005 |
| JP | 2007-284297 | A | 11/2007 |
| JP | 2010-040860 | A | 2/2010 |
| JP | 2010-245088 | A | 10/2010 |
| JP | 2011-233468 | A | 11/2011 |
| JP | 2012-049372 | A | 3/2012 |
| JP | 2014-027071 | A | 2/2014 |
| JP | 2014-063782 | A | 4/2014 |
| KR | 2010-0029156 | A | 3/2010 |
| WO | 2009/034824 | A1 | 3/2009 |
| WO | 2009/133766 | A1 | 11/2009 |
| WO | 2010/026825 | A1 | 3/2010 |
| WO | 2010/035559 | A1 | 4/2010 |

OTHER PUBLICATIONS

An Office Action; "Notice of Reasons for Rejection," issued by the Japanese Patent Office dated Oct. 17, 2017, which corresponds to Japanese Patent Application No. 2015-090710 and is related to U.S. Appl. No. 15/095,425; with English language translation.

First Notification of Office Action issued by the State Intellectual Property Office of the People's Republic of China dated Jul. 4, 2017, which corresponds to Chinese Patent Application No. 201610245027.6 and is related to U.S. Appl. No. 15/095,425; with English language translation.

Notification of the Second Office Action issued by the State Intellectual Property Office of the People's Republic of China dated Mar. 12, 2018, which corresponds to Chinese Patent Application No. 201610245027.6 and is related to U.S. Appl. No. 15/095,425.

* cited by examiner

ELECTRONIC COMPONENT AND METHOD FOR MANUFACTURING THE SAME

CROSS REFERENCE TO RELATED APPLICATIONS

This application claims benefit of priority to Japanese Patent Application 2015-090710 filed Apr. 27, 2015, the entire content of which is incorporated herein by reference.

TECHNICAL FIELD

The present disclosure relates to an electronic component and a method for manufacturing the same. In particular, the present disclosure relates to an electronic component including a coil and a method for manufacturing the same.

BACKGROUND

To date, a multilayer coil component described in International Publication No. WO 2009/034824 is known as an disclosure related to the electronic component. The multilayer coil component includes a ceramic multilayer body, a spiral coil, and outer electrodes. The ceramic multilayer body is disposed by stacking magnetic ceramic layers. The spiral coil is disposed by interlayer-connecting internal conductors. The outer electrodes are disposed on the surfaces of the ceramic multilayer body. The pore area ratio of a side gap portion of the ceramic multilayer body is within the range of about 6% to 20%. Consequently, at the time of formation of the outer electrodes by plating, an acidic plating solution reaches the interface between the internal conductor and the magnetic ceramic around the internal conductor through the side gap portion. As a result, the coupling between the internal conductor and the magnetic ceramic around the internal conductor at the interface is cut.

In the above-described electronic component, the coupling between the internal conductor and the magnetic ceramic around the internal conductor at the interface is cut and, thereby, internal stress generated between the internal conductor and the magnetic ceramic layer because of differences in firing shrinkage behavior and thermal expansion coefficient is relaxed.

However, regarding the multilayer coil component described in International Publication No. WO 2009/034824, it is estimated that the pore area ratio of the portion other than the side gap portion (for example, a portion interposed between two inner electrodes in the stacking direction) increases. Consequently, the pore area ratio of the entirety of the ceramic multilayer body increases and the strength of the ceramic multilayer body is reduced.

SUMMARY

Accordingly, it is an object of the present disclosure to provide an electronic component, in which the strength of a multilayer body can be enhanced while internal stress is relaxed, and a method for manufacturing the same.

According to preferred embodiments of the present disclosure, an electronic component includes a multilayer body having a configuration, in which a plurality of insulator layers containing ferrite ceramic are stacked in a stacking direction, and a coil having a configuration, in which a plurality of coil conductor layers containing Ag and being disposed on the insulator layers are connected to at least one via hole conductor penetrating the insulator layer in the stacking direction, and having a spiral shape spiraling in the stacking direction, wherein a first pore area ratio of a side gap interposed between an outer circumferential edge of an annular track formed by stacking the plurality of coil conductor layers and an outer edge of the multilayer body, when viewed in the stacking direction, is about 9.0% or more and 20.0% or less, and a second pore area ratio of a portion interposed between two coil conductor layers in the stacking direction is about 8.0% or less.

According to preferred embodiments of the present disclosure, a method for manufacturing an electronic component including a multilayer body having a configuration, in which a plurality of insulator layers containing ferrite ceramic are stacked in a stacking direction, and a coil having a configuration, in which a plurality of coil conductor layers containing Ag and being disposed on the insulator layers are connected to at least one via hole conductor penetrating the insulator layer in the stacking direction, and having a spiral shape spiraling in the stacking direction, includes the steps of forming a conductor by forming the plurality of coil conductor layers on a plurality of mother insulator layers and the at least one via hole conductor in the plurality of mother insulator layers, stacking and pressure bonding the plurality of mother insulator layers, which are provided with the coil conductor layers and the via hole conductor, one after another so as to obtain a mother multilayer body, dividing the mother multilayer body into a plurality of the multilayer bodies, firing each of the multilayer bodies, and making an acidic solution permeate into the fired multilayer body, wherein the mother multilayer body is not subjected to pressure bonding after the stacking and pressure bonding to obtain the mother multilayer body.

According to preferred embodiments of the present disclosure, a method for manufacturing an electronic component including a multilayer body having a configuration, in which a plurality of insulator layers containing ferrite ceramic are stacked in a stacking direction, and a coil having a configuration, in which a plurality of coil conductor layers containing Ag and being disposed on the insulator layers are connected to at least one via hole conductor penetrating the insulator layer in the stacking direction, and having a spiral shape spiraling in the stacking direction, includes the steps of forming a conductor by forming the plurality of coil conductor layers on a plurality of mother insulator layers and the at least one via hole conductor in the plurality of mother insulator layers, stacking and pressure bonding the plurality of mother insulator layers, which are provided with the coil conductor layers and the via hole conductor, one after another so as to obtain a mother multilayer body, pressure bonding the mother multilayer body at a pressure of 400 kgf/cm$^2$ or less, dividing the mother multilayer body into a plurality of the multilayer bodies, firing each of the multilayer bodies, and making an acidic solution permeate into the fired multilayer body.

Other features, elements, characteristics and advantages of the present disclosure will become more apparent from the following detailed description of preferred embodiments of the present disclosure with reference to the attached drawings.

DETAILED DESCRIPTION

Structure of Electronic Component

Figure 1:
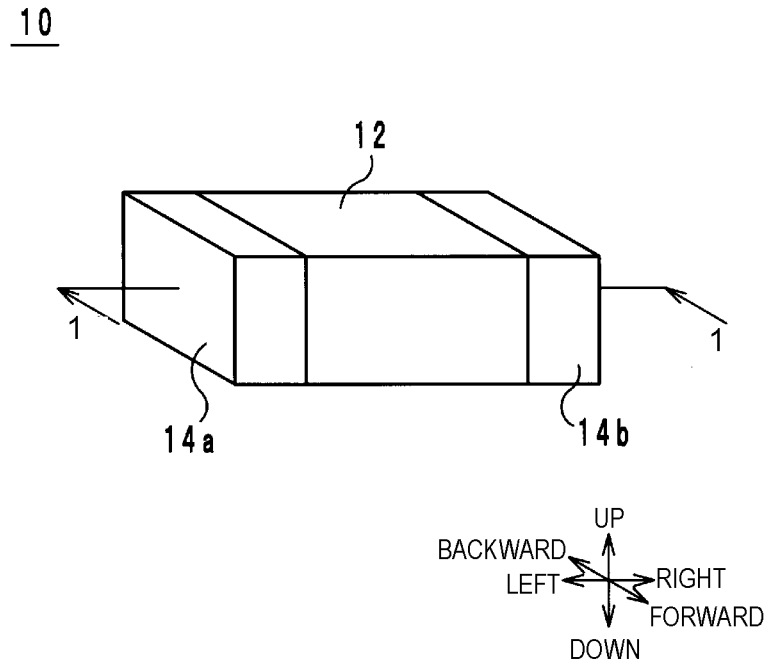
FIG. 1 shows an outside perspective view of an electronic component.
Figure 2:
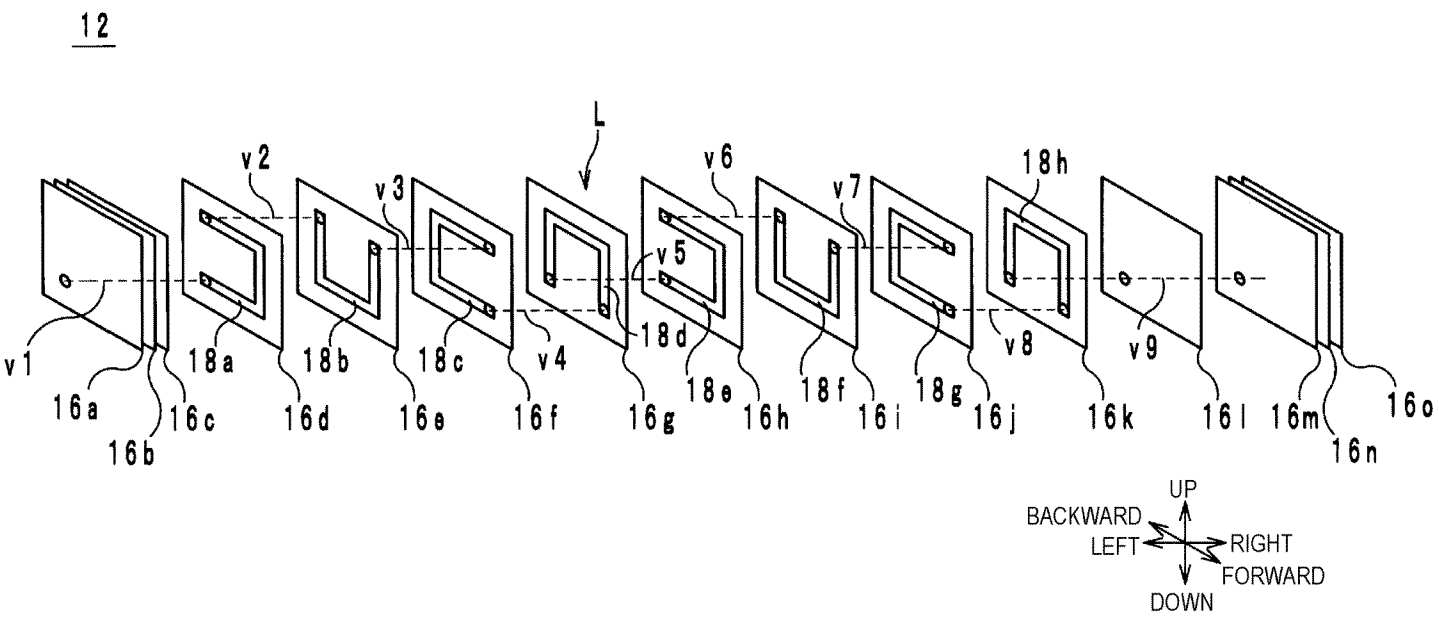
FIG. 2 shows an exploded perspective view of a multilayer body of the electronic component.

An electronic component according to an embodiment of the present disclosure will be described below with reference to the drawings. FIG. 1 shows an outside perspective view of an electronic component 10. FIG. 2 shows an exploded perspective view of a multilayer body 12 of the electronic component 10. Hereafter the stacking direction of the electronic component 10 is defined as the lateral direction and, when the electronic component 10 is viewed from the left, the directions of extension of one side and the other side are defined as the forward or backward direction and the vertical direction, respectively. The vertical direction, the forward or backward direction, and the lateral direction are orthogonal to each other.

As shown in FIG. 1 and FIG. 2, the electronic component 10 includes a multilayer body 12, a coil L, and outer electrodes 14*a* and 14*b*. The multilayer body 12 has a substantially rectangular parallelepiped shape and has a configuration, in which insulator layers 16*a* to 16*o* are stacked in that order from left to right, as shown in FIG. 2.

The insulator layers 16*a* to 16*o* have a substantially square shape when viewed from the left. However, the insulator layers 16*a* to 16*o* may have a substantially rectangular shape when viewed from the left. The insulator layers 16*a* to 16*o* contain ferrite ceramic and, in the present embodiment, contain NiCuZn ferrite ceramic. The material forming the insulator layers 16*a* to 16*o* is not limited to this. Hereafter the left principal surfaces of the insulator layers 16*a* to 16*o* are referred to as surfaces and the right principal surfaces of the insulator layers 16*a* to 16*o* are referred to as back surfaces.

The outer electrode 14*a* covers the entire left surface of the multilayer body 12 and, in addition, covers part of each of the upper surface, the lower surface, the front surface, and the rear surface of the multilayer body 12. The outer electrode 14*b* covers the entire right surface of the multilayer body 12 and, in addition, covers part of each of the upper surface, the lower surface, the front surface, and the rear surface of the multilayer body 12. The outer electrodes 14*a* and 14*b* are produced by, for example, producing underlying electrodes from an electrically conductive paste containing Ag as a primary component and, thereafter, subjecting the underlying electrodes to Ni plating and Sn plating in that order. However, the shape and the material of the outer electrodes 14*a* and 14*b* are not limited to these.

As shown in FIG. 2, the coil L includes coil conductor layers 18*a* to 18*h* and via hole conductors v1 to v9. The coil conductor layers 18*a* to 18*h* are disposed on the surfaces of the insulator layers 16*d* to 16*k*, respectively. Each of the coil conductor layers 18*a* to 18*h* has the shape of a substantially square frame, where one side is cut away, or the shape of a substantially square-cornered letter U. That is, each of the coil conductor layers 18*a* to 18*h* has a length of three-quarters of a turn. The coil conductor layers 18*a* to 18*h* are stacked one on another and form a substantially square frame-like track R when viewed from the left. However, the lengths and the shapes of the coil conductor layers 18*a* to 18*h* are not limited to these. Hereafter, when viewed from the left, the end portions on the upstream side in the counterclockwise direction of the coil conductor layers 18*a* to 18*h* are referred to as upstream ends and the end portions on the downstream side in the counterclockwise direction of the coil conductor layers 18*a* to 18*h* are referred to as downstream ends.

The via hole conductor v1 penetrates the insulator layers 16*a* to 16*c* in the lateral direction and connects the outer electrode 14*a* to the upstream end of the coil conductor layer 18*a*. The via hole conductor v2 penetrates the insulator layer 16*d* in the lateral direction and connects the downstream end of the coil conductor layer 18*a* to the upstream end of the coil conductor layer 18*b*. The via hole conductor v3 penetrates the insulator layer 16*e* in the lateral direction and connects the downstream end of the coil conductor layer 18*b* to the upstream end of the coil conductor layer 18*c*. The via hole conductor v4 penetrates the insulator layer 16*f* in the lateral direction and connects the downstream end of the coil conductor layer 18*c* to the upstream end of the coil conductor layer 18*d*. The via hole conductor v5 penetrates the insulator layer 16*g* in the lateral direction and connects the downstream end of the coil conductor layer 18*d* to the upstream end of the coil conductor layer 18*e*. The via hole conductor v6 penetrates the insulator layer 16*h* in the lateral direction and connects the downstream end of the coil conductor layer 18*e* to the upstream end of the coil conductor layer 18*f*. The via hole conductor v7 penetrates the insulator layer 16*i* in the lateral direction and connects the downstream end of the coil conductor layer 18*f* to the upstream end of the coil conductor layer 18*g*. The via hole conductor v8 penetrates the insulator layer 16*j* in the lateral direction and connects the downstream end of the coil conductor layer 18*g* to the upstream end of the coil conductor layer 18*h*. The via hole conductor v9 penetrates the insulator layers 16*k* to 16*o* in the lateral direction and connects the downstream end of the coil conductor layer 18*h* to the outer electrode 14*b*.

The coil conductor layers 18*a* to 18*h* and the via hole conductors v1 to v9 are produced from, for example, an electrically conductive paste containing Ag as a primary component.

The above-described coil L has a substantially counterclockwise spiral shape, when viewed from the left, and spirals from left to right.

Figure 3A:
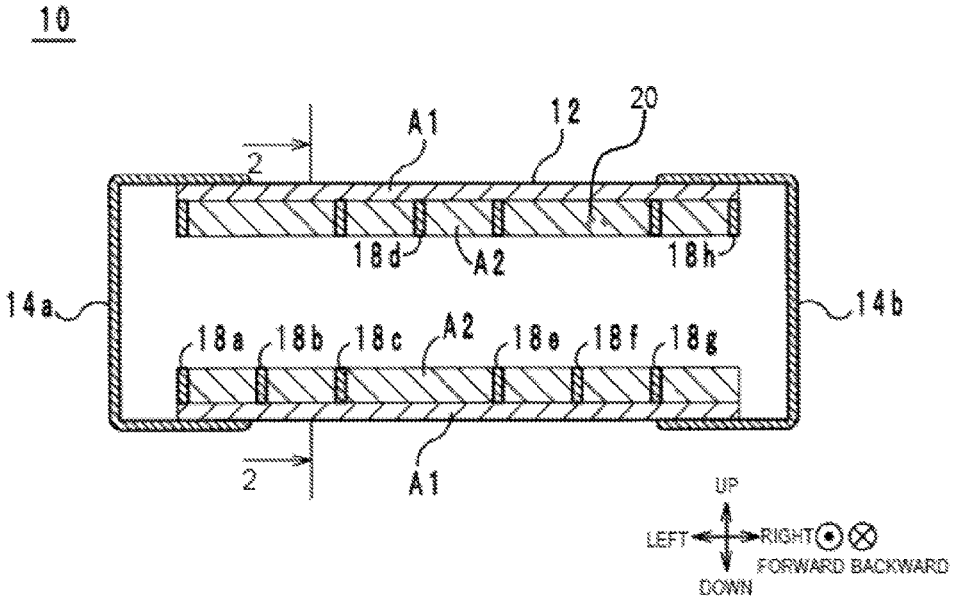
FIG. 3A shows a structural sectional view along a line 1-1 shown in FIG. 1.
Figure 3B:
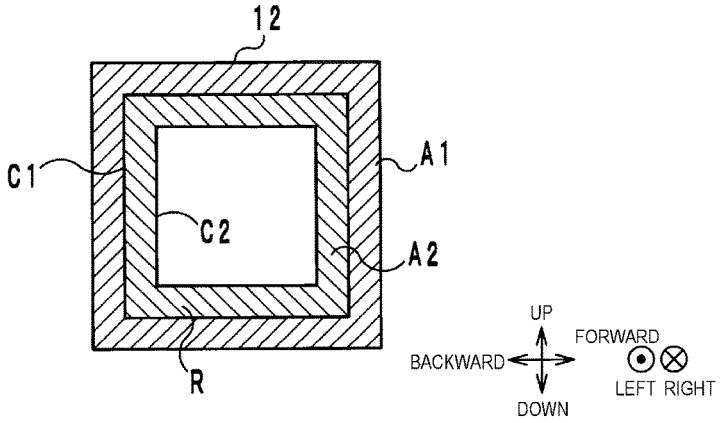
FIG. 3B shows a structural sectional view along a line 2-2 shown in FIG. 3A.

The electronic component 10 has a structure described below in order to enhance the strength of the multilayer body 12 while internal stress is relaxed. FIG. 3A shows a structural sectional view along a line 1-1 shown in FIG. 1. FIG. 3B shows a structural sectional view along a line 2-2 shown in FIG. 3A.

Individual portions of the multilayer body 12 will be defined. The annular track formed by stacking the coil conductor layers 18*a* to 18*h* is defined as a track R. The track R has a substantially square frame shape. The outer circumferential edge of the track R is defined as an outer edge C1, and the inner circumferential edge of the track R is defined as an outer edge C2. In the multilayer body 12, the region interposed between the outer edge C1 and the outer edge in the multilayer body 12 is defined as a side gap A1. The left end of the side gap A1 is the left principal surface of the coil conductor layer 18*a*, and the right end of the side gap A1 is the right principal surface of the coil conductor layer 18*h*.

The region interposed in the lateral direction between two coil conductor layers of the coil conductor layers 18*a* to 18*h* is defined as an interlayer portion A2. Pores 20 are disposed in interlayer portions A2 of the multilayer body 12. As shown in FIG. 3B, the interlayer portion A2 is the region interposed between the outer edge C1 and the outer edge C2 and corresponds to the track R when viewed from the left. The left end of the interlayer portion A2 is the surface of the insulator layer 16*d* and the right end of the interlayer portion A2 is the back surface of the insulator layer 16*j*.

The pore area ratio P1 of the side gap A1 is about 9.0% or more and 20.0% or less. However, the pore area ratio P1 of at least the center in the lateral direction of the side gap A1 needs to be about 9.0% or more and 20.0% or less. It is most preferable that the pore area ratio P1 of the entire side gap A1 be about 9.0% or more and 20.0% or less. The pore area ratio P2 is about 0% or more and 8.0% or less and more preferably about 0.7% or more and 7.7% or less. However, the pore area ratio P2 of the portion interposed between the coil conductor layer nearest the center in the lateral direction of the multilayer body 12 and the coil conductor layer next to the nearest needs to be about 0% or more and 8.0% or less and more preferably about 0.7% or more and 7.7% or less. The pore area ratio P2 of the entire interlayer portion A2 is preferably about 0% or more and 8.0% or less and particularly preferably about 0.7% or more and 7.7% or less. The difference between the pore area ratio P1 and the pore area ratio P2 is preferably about 4.0% or more. The pore area ratio refers to the proportion of the area of pores (porosities) per unit area of the cross section of the multilayer body 12. The pore is a space formed in the insulator and the material forming the insulator is not present therein.

Method For Manufacturing Electronic Component

Figure 4A:
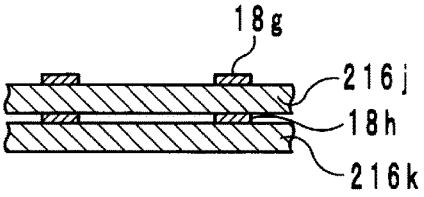
FIG. 4A shows a structural sectional view at the time of stacking of insulator layers.
Figure 4B:
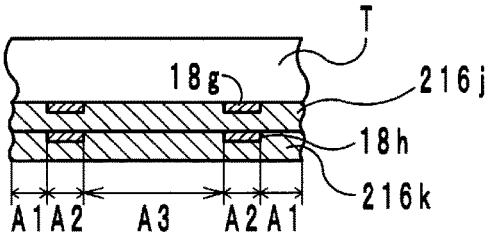
FIG. 4B shows a structural sectional view at the time of stacking of insulator layers.

A method for manufacturing the electronic component 10 will be described below with reference to the drawings. FIG. 4A and FIG. 4B show structural sectional views at the time of stacking of the insulator layers 16*k* and 16*j*.

Ceramic green sheets 216*a* to 216*o* (examples of the mother insulator layers) to be converted into the insulator layers 16*a* to 16*o* are prepared. Specifically, raw materials composed of about 48 percent by mole of ferric oxide ($Fe_2O_3$), about 29.5 percent by mole of zinc oxide (ZnO), about 14.5 percent by mole of nickel oxide (NiO), and about 7.7 percent by mole of copper oxide (CuO) are put into a ball mill, and wet blending is performed. The resulting mixture is dried and, thereafter, is ground. The resulting powder is calcined at about 700° C. for about 2 hours. The resulting calcined powder is wet ground in a ball mill for about 16 hours. Subsequently, drying and disintegration are performed so as to obtain a ferrite ceramic powder.

A binder, (vinyl acetate, water-soluble acryl, or the like), a plasticizer, a wetting agent, and a dispersing agent are added to the resulting ferrite ceramic powder and mixing is performed in a ball mill. Thereafter, degassing is performed under reduced pressure. The resulting ceramic slurry is formed into a sheet on a carrier sheet by a doctor blade method and drying is performed so as to produce ceramic green sheets 216*a* to 216*o* to be converted into the insulator layers 16*a* to 16*o*. The thicknesses of the ceramic green sheets 216*a* to 216*o* are about 13.0 μm.

Then, the via hole conductors v1 to v9 are formed appropriately in the ceramic green sheets 216*a* to 216*o* to be converted into the insulator layers 16*a* to 16*o*. Specifically, via holes are formed by radiating laser beams to the ceramic green sheets 216*a* to 216*o* to be converted into the insulator layers 16*a* to 16*o*. The via holes are filled with a paste composed of an electrically conductive material, e.g., Ag, Pd, Cu, Au, or an alloy thereof, by printing, coating, or the like so as to form the via hole conductors v1 to v9.

The coil conductor layers 18*a* to 18*h* are formed by coating the ceramic green sheets 216*a* to 216*o* to be converted into the insulator layers 16*a* to 16*o* with an electrically conductive paste by a screen printing method, photolithography, or the like. The electrically conductive paste is prepared by, for example, adding a varnish and a solvent to Ag. In this regard, the step of forming the coil conductor layers 18*a* to 18*h* and the step of filling the via holes with the paste composed of the electrically conductive material may be performed in one step.

Subsequently, the ceramic green sheets 216*a* to 216*o* to be converted into the insulator layers 16*a* to 16*o* are stacked so as to obtain an unfired mother multilayer body. Specifically, as shown in FIGS. 4A and 4B, the ceramic green sheets 216*a* to 216*o* to be converted into the insulator layers 16*a* to 16*o* are stacked and temporarily pressure-bonded one after another. Regarding the temporary pressure bonding condition, for example, the pressure is about 100 kgf/cm$^2$ and the duration is about 3 seconds to 30 seconds. As shown in FIG. 4A, the thickness in the lateral direction of the portion including the coil conductor layers 18*g* and 18*h* is larger than the thickness in the lateral direction of the portion including neither the coil conductor layer 18*g* nor 18*h*. Therefore, as shown in FIG. 4B, in the case where the ceramic green sheets 216*j* and 216*k* provided with the coil conductor layers 18*g* and 18*h* are temporarily pressure-bonded, the side gap A1 and the region A3, which are provided with neither the coil conductor layer 18*g* nor 18*h*, are pressure-bonded to a lower degree than the interlayer portion A2 provided with the coil conductor layers 18*g* and 18*h*. Consequently, the densities of the material forming the ceramic green sheets in the side gap A1 and the region A3 are lower than the density of the material forming the ceramic green sheets in the interlayer portion A2. Thereafter, the unfired mother multilayer body is not subjected to regular pressure bonding. However, as necessary, the mother multilayer body may be subjected to regular pressure bonding at a low pressure of about 400 kgf/cm$^2$ or less.

The mother multilayer body is divided into a plurality of multilayer bodies 12. Specifically, the mother multilayer body is cut into the plurality of multilayer bodies 12 having predetermined dimensions by a cutting edge. In this manner, the unfired multilayer body 12 is obtained.

The unfired multilayer body 12 is subjected to debinding and firing. The densities of the material forming the ceramic green sheets 216*a* to 216*o* in the side gap A1 and the region A3 are lower than the density of the material forming the ceramic green sheets 216*a* to 216*o* in the interlayer portion A2. As a result, the pore area ratios of the side gap A1 and the region A3 are larger than the pore area ratio of the interlayer portion A2. Specifically, the pore area ratios P1 of the side gap A1 and the region A3 are about 9.0% or more and 20.0% or less. The pore area ratio P2 of the interlayer portion A2 is about 0.7% or more and 8.0% or less. The conditions for the debinding and the firing will be described later.

The fired multilayer body 12 is obtained by the above-described steps. The multilayer body 12 is subjected to barrel finishing so as to be chamfered. Thereafter, the surface of the multilayer body 12 is coated with an electrode paste composed of an electrically conductive material containing Ag as a primary component. The electrode paste applied is baked for about 60 minutes at a temperature of about 750°

C. In this manner, underlying electrodes of the outer electrodes 14*a* and 14*b* are formed.

Then, the multilayer body 12 is dipped into a $NiCl_2$ solution (an example of the acidic solution). Consequently, the $NiCl_2$ solution permeates up to the interfaces between the coil conductor layers 18*a* to 18*h* and the insulator layers 16*c* to 16*l* around the coil conductor layers 18*a* to 18*h* through the side gap A1. As a result, the couplings between the coil conductor layers 18*a* to 18*h* and the insulator layers 16*c* to 16*l* around the coil conductor layers 18*a* to 18*h* at the interfaces are cut by the $NiCl_2$ solution.

Finally, the surface of the underlying electrode is subjected to Ni plating and, thereafter, Sn plating so as to form the outer electrodes 14*a* and 14*b*. The electronic component 10 shown in FIG. 1 is completed by the above-described steps.

Advantages

According to the electronic component 10 having the above-described configuration, the internal stress is relaxed. Specifically, the pore area ratio P1 of the side gap A1 is about 9.0% or more and 20.0% or less. Therefore, when the multilayer body 12 is dipped into the $NiCl_2$ solution, the $NiCl_2$ solution permeates up to the interfaces between the coil conductor layers 18*a* to 18*h* and the insulator layers 16*c* to 16*l* around the coil conductor layers 18*a* to 18*h* through the side gap A1. As a result, the couplings between the coil conductor layers 18*a* to 18*h* and the insulator layers 16*c* to 16*l* around the coil conductor layers 18*a* to 18*h* at the interfaces are cut by the $NiCl_2$ solution. That is, the coil conductor layers 18*a* to 18*h* are in contact with the insulator layers 16*c* to 16*l* without adhesion therebetween. Consequently, the internal stress generated between the coil conductor layers 18*a* to 18*h* and the insulator layers 16*c* to 16*l* is relaxed. As a result, changes in the magnetic permeability and the like due to the application of stress to the insulator layers 16*c* to 16*l* can be suppressed.

In the electronic component 10, the pore area ratio P2 of the interlayer portion A2 is about 0.7% or more and 8.0% or less. Consequently, as is also clear from the experimental results described later, the strength of the multilayer body 12 is enhanced.

EXPERIMENTS

In order to make the effects of the electronic component 10 more apparent, the present inventors conducted the experiments described below. The present inventors formed 30 each of Sample 1 to Sample 27. Temporary pressure bonding and regular pressure bonding were performed on Sample 1 to Sample 9. The pressure of the temporary pressure bonding was specified as 100 kgf/cm$^2$. The pressure of the regular pressure bonding was specified as 1,000 kgf/cm$^2$. Regarding Sample 1 to Sample 9, the maximum temperature of the firing temperature (hereafter simply referred to as firing temperature) was changed from 850° C. to 910° C. The temporary pressure bonding and the regular pressure bonding were performed on Sample 10 to Sample 18. The pressure of the temporary pressure bonding was specified as 100 kgf/cm$^2$. The pressure of the regular pressure bonding was specified as 400 kgf/cm$^2$. Regarding Sample 10 to Sample 18, the firing temperature was changed from 860° C. to 920° C. Regarding Sample 19 to Sample 27, only the temporary pressure bonding was performed and the regular pressure bonding was not performed. The pressure of the temporary pressure bonding was specified as 100 kgf/cm$^2$. Regarding Sample 19 to Sample 27, the firing temperature was changed from 870° C. to 930° C.

The sizes of Sample 1 to Sample 27 were as described below.

Length in the lateral direction: 0.6 mm

Length in the forward or backward direction: 0.3 mm

Length in the vertical direction: 0.3 mm

The number of turns of the coil L in Sample 1 to Sample 27 was 30 turns. The target value of the impedance characteristics at 100 MHz was set at 1,200 Ω (tolerance of ±10%).

Regarding Sample 1 to Sample 27 above, the pore area ratio P1 of the side gap A1 and the pore area ratio P2 of the interlayer portion A2 were measured. The impedance characteristics at 100 MHz of Sample 1 to Sample 27 were measured. The flexural strengths of Sample 1 to Sample 27 were measured. In addition, Sample 1 to Sample 27 were subjected to a first bending test. Each measurement will be described below in detail.

(a) Measurement of Pore Area Ratio

A cross section perpendicular to the forward or backward direction of the multilayer body 12 was subjected to mirror polishing and focused ion beam milling (FIB milling), and the resulting surface was observed by a scanning electron microscope (SEM), so that the pore area ratio of the multilayer body 12 after the sintering was measured.

Specifically, the pore area ratio was measured by using the image processing software "Azokun". A specific measuring method is as described below.

FIB apparatus: SMI3050R produced by SII

Scanning electron microscope (SEM): S-4800 produced by Hitachi High-Technologies Corporation Image processing software: "Azokun" produced by Asahi Kasei Corporation Focused ion beam milling (FIB milling)

Figure 4C:
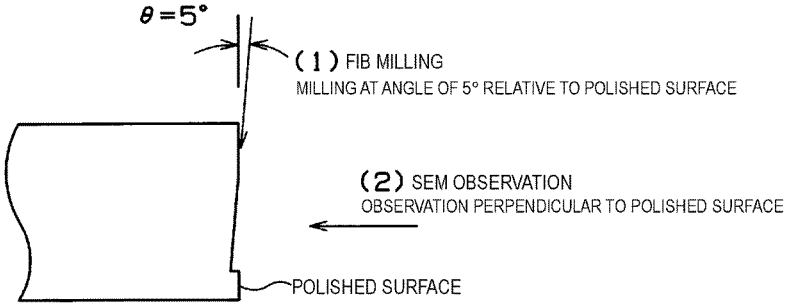
FIG. 4C shows a diagram illustrating focused ion beam milling.

FIG. 4C shows a diagram illustrating focused ion beam milling. As shown in FIG. 4C, the polished surface of the sample after the mirror polishing was subjected to FIB milling at an incident angle of 5°.

Observation by scanning electron microscope (SEM)

SEM observation was performed under the conditions described below.

Acceleration voltage: 5 kV

Sample inclination: 5°

Signal: secondary electron

Coating: Pt

Magnification: 5,000 times

Calculation of pore area ratio

The pore area ratio was determined by the following method.

a) The measurement range is determined. If the range is too narrow, an error occurs depending on the measurement location (in the present example, the measurement range was specified as 24.76 μm×14.39 μm).

b) If the magnetic ceramic is not clearly distinguished from the pore, the brightness and the contrast are adjusted.

c) Binarization is performed and only pores are extracted. In the case where the results of the "color extraction" of the image processing software "Azokun" are unsatisfactory, these are compensated for manually.

d) In the case where areas other than pores are extracted, the areas other than pores are excluded.

e) The total area, the number of pores, the pore area ratio, and the area of the measurement range are measured by using "Total area·Number measurement" of the image processing software.

f) In the case where the inner electrode is included in the image, the area of the portion of the inner electrode is considered to be included in the area of unnecessary portions, and the pore area ratio is calculated by using the following formula.

pore area ratio=total area of pores/(area of measurement range−total area of unnecessary portions)×100

When determining the pore area ratio P1 of the side gap A1, the pore area ratio of the center in the lateral direction of the side gap A1 was measured. When determining the pore area ratio P2 of the interlayer portion A2, the pore area ratio of the portion between the coil conductor layer nearest the center in the lateral direction of the multilayer body 12 and the coil conductor layer next to the nearest were measured.

(b) Measurement of Impedance Characteristics

After 30 each of Sample 1 to Sample 27 were prepared, the impedance at 100 MHz was measured by using an impedance analyzer (HP4291A produced by Hewlett-Packard Company), and the average value was determined.

(c) Measurement of Flexural Strength

Regarding 30 samples, the measurement was performed by a testing method specified in EIAJ-ET-7403, and the strength at the failure probability=1% in the Weibull plot was taken as the flexural strength.

(d) First Bending Test

Each of 30 samples was mounted on a glass epoxy substrate having a substrate thickness of 0.8 mm. The center portion of the back surface of the resulting substrate was pushed toward the surface direction by a push rod so as to bend the substrate by 2.0 mm and the resulting state was held for 30 seconds.

Figure 5:
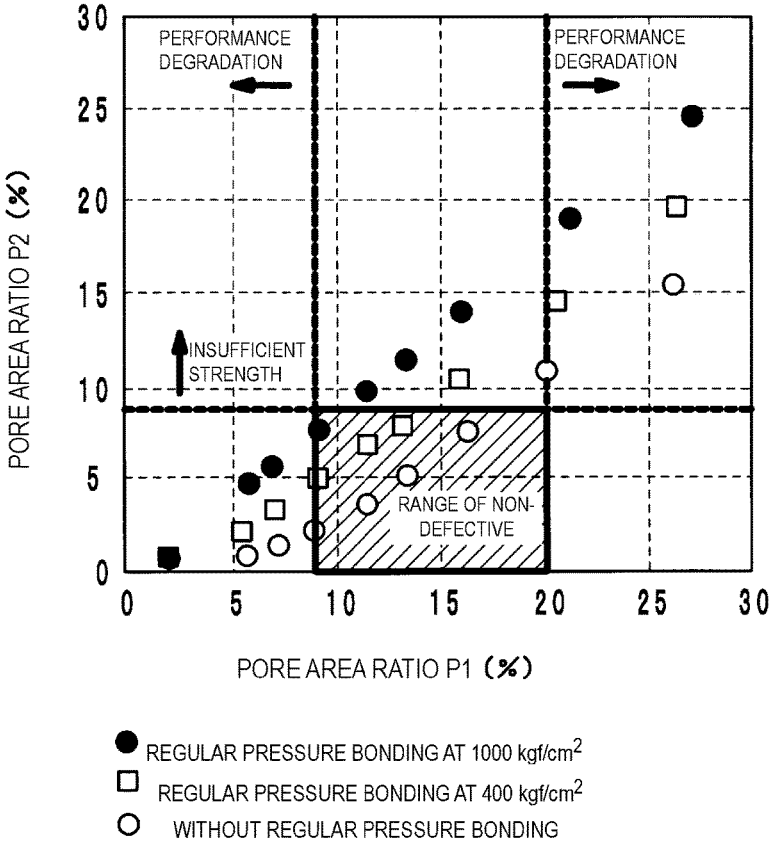
FIG. 5 shows a graph of experimental results.

Table 1 to Table 3 show the experimental results. FIG. 5 shows a graph of experimental results. The horizontal axis indicates the pore area ratio P1 and the vertical axis indicates the pore area ratio P2.

TABLE 1

| Sample | 1 | 2 | 3 | 4 | 5 | 6 | 7 | 8 | 9 |
|---|---|---|---|---|---|---|---|---|---|
| Firing temperature (° C.) | 850 | 860 | 870 | 875 | 880 | 885 | 890 | 895 | 910 |
| Pore area ratio P2 (%) | 25.0 | 19.4 | 14.3 | 11.7 | 10.0 | 7.9 | 5.8 | 4.9 | 1.2 |
| Pore area ratio P1 (%) | 27.0 | 21.2 | 16.0 | 13.3 | 11.5 | 9.2 | 7.0 | 5.9 | 2.0 |
| P1 − P2 (%) | 2.0 | 1.8 | 1.7 | 1.6 | 1.5 | 1.3 | 1.2 | 1.0 | 0.8 |
| Impedance characteristics Z at 100 MHz (Ω) | 1022 | 1109 | 1161 | 1210 | 1235 | 1203 | 896 | 695 | 512 |
| Evaluation of impedance characteristics | x | ○ | ○ | ○ | ○ | ○ | x | x | x |
| Flexural strength (N) | 0.8 | 1.1 | 1.9 | 2.5 | 3.2 | 4.4 | 4.8 | 5.0 | 5.2 |
| First bending test | x | x | x | x | x | ○ | ○ | ○ | ○ |
| Evaluation | | | | | | ○ | | | |

TABLE 2

| Sample | 10 | 11 | 12 | 13 | 14 | 15 | 16 | 17 | 18 |
|---|---|---|---|---|---|---|---|---|---|
| Firing temperature (° C.) | 860 | 870 | 880 | 885 | 890 | 895 | 900 | 905 | 920 |
| Pore area ratio P2 (%) | 19.9 | 14.8 | 10.5 | 8.0 | 6.9 | 5.1 | 3.4 | 2.2 | 0.8 |
| Pore area ratio P1 (%) | 26.3 | 20.5 | 15.9 | 13.2 | 11.5 | 9.1 | 7.0 | 5.5 | 2.0 |
| P1 − P2 (%) | 6.4 | 5.7 | 5.4 | 5.2 | 4.6 | 4.0 | 3.6 | 3.3 | 1.2 |
| Impedance characteristics Z at 100 MHz (Ω) | 1036 | 1118 | 1178 | 1242 | 1264 | 1249 | 947 | 661 | 522 |
| Evaluation of impedance characteristics | x | ○ | ○ | ○ | ○ | ○ | x | x | x |
| Flexural strength (N) | 1.1 | 1.7 | 2.8 | 4.1 | 4.6 | 4.9 | 5.0 | 5.2 | 5.3 |
| First bending test | x | x | x | ○ | ○ | ○ | ○ | ○ | ○ |
| Evaluation | | | | ○ | ○ | ○ | | | |

TABLE 3

| Sample | 19 | 20 | 21 | 22 | 23 | 24 | 25 | 26 | 27 |
|---|---|---|---|---|---|---|---|---|---|
| Firing temperature (° C.) | 870 | 880 | 890 | 895 | 900 | 905 | 910 | 915 | 930 |
| Pore area ratio P2 (%) | 15.7 | 11.0 | 7.7 | 5.3 | 3.7 | 2.3 | 1.5 | 0.9 | 0.7 |
| Pore area ratio P1 (%) | 26.2 | 20.0 | 16.3 | 13.4 | 11.5 | 9.0 | 7.2 | 5.8 | 2.0 |
| P1 − P2 (%) | 10.5 | 9.0 | 8.6 | 8.1 | 7.8 | 6.7 | 5.7 | 4.9 | 1.3 |
| Impedance characteristics Z at 100 MHz (Ω) | 1055 | 1132 | 1203 | 1233 | 1259 | 1188 | 828 | 592 | 502 |
| Evaluation of impedance characteristics | x | ○ | ○ | ○ | ○ | ○ | x | x | x |
| Flexural strength (N) | 1.5 | 2.5 | 4.0 | 4.9 | 5.0 | 5.3 | 5.3 | 5.2 | 5.4 |
| First bending test | x | x | ○ | ○ | ○ | ○ | ○ | ○ | ○ |
| Evaluation | | | ○ | ○ | ○ | ○ | | | |

In Table 1 to Table 3, the sample exhibited impedance characteristics of 1,080 Ω or more (that is, within −10% of target impedance value of 1,200 Ω) was rated as a non-defective product and the sample exhibited impedance characteristics of less than 1,080 Ω was rated as a defective product. The evaluation whether the sample is non-defective or defective on the basis of the impedance characteristics is equivalent to the evaluation whether the sample is non-defective or defective on the basis of the internal stress. That is, in the case where the internal stress is relaxed, degradation of the magnetic permeability of the insulator layer is suppressed and a sufficient inductance value is secured, so that the impedance characteristics are relatively enhanced. On the other hand, in the case where the internal stress is not relaxed, the magnetic permeability of the insulator layer is reduced and a sufficient inductance value is not secured, so that the impedance characteristics are relatively reduced.

In this regard, as the firing temperature increases, the number of samples rated as defective products on the basis of the impedance characteristics increases. This is because as the firing temperature increases, the multilayer body 12 is sufficiently fired, the pore area ratio P1 of the side gap A1 is reduced and, thereby, the $NiCl_2$ solution does not permeate into the multilayer body 12 easily.

The sample exhibited flexural strength of 4.0 N or more was rated as a non-defective product and the sample exhibited flexural strength of less than 4.0 N was rated as a defective product. Regarding the bending test, the sample, in which cracking of the multilayer body did not occur after the amount of bending of 2.0 mm was held for 30 seconds, was rated as a non-defective product. In Table 1 to Table 3, the case where all 30 samples were non-defective products was indicated by a symbol ○, and the case where any of the 30 samples was defective product was indicated by a symbol X. The strength of the multilayer body 12 was rated on the basis of the first bending test and the flexural strength test.

According to Table 1 to Table 3 and FIG. 5, in the case where the pore area ratio P1 of the side gap A1 was 9.0% or more, the sample was rated as a non-defective product on the basis of the impedance characteristic test. This is because as the pore area ratio P1 of the side gap A1 increases, the $NiCl_2$ solution permeates into the multilayer body 12 easily. As a result, the internal stress is relaxed, and reduction of the inductance value of the electronic component is suppressed. However, if the pore area ratio P1 of the side gap A1 is too large (for example, more than about 20%), the magnetic permeability of the multilayer body is reduced, so that the inductance value of the electronic component is reduced. Therefore, the pore area ratio P1 is preferably about 9.0% or more and 20.0% or less.

Meanwhile, according to Table 1 to Table 3 and FIG. 5, in the case where the pore area ratio P2 of the interlayer portion A2 was 8.0% or less, the sample was rated as a non-defective product on the basis of the first bending test and the flexural strength test. This is because the pore area ratio P2 of the interlayer portion A2 was small and, thereby, the strength of the multilayer body was enhanced. In this regard, the pore area ratio P2 is preferably small and may be about 0%. However, the pore area ratio P2 is preferably about 0.7% or more.

Sample 6, Sample 13 to Sample 15, and Sample 21 to Sample 24 were rated as non-defective products on the basis of the impedance characteristic test, the first bending test, and the flexural strength test. Regarding Sample 6, Sample 13 to Sample 15, and Sample 21 to Sample 24, the pore area ratios P1 were 9.0% or more and 20.0% or less and the pore area ratios P2 were 0.7% or more and 8.0% or less. Consequently, according to the experiments, in the case where the pore area ratio P1 is about 9.0% or more and 20.0% or less and the pore area ratio P2 is about 0.7% or more and 8.0% or less, the internal stress is relaxed and, in addition, the strength of the multilayer body 12 can be enhanced.

According to the experiment, when the electronic component 10 is produced, in the case where the regular pressure bonding is not performed or the regular pressure bonding is performed at a low pressure (about 400 kgf/cm$^2$ or less), the electronic component 10 exhibiting a pore area ratio P1 of about 9.0% or more and 20.0% or less and, in addition, a pore area ratio P2 of about 0.7% or more and 8.0% or less can be obtained easily compared with the case where the regular pressure bonding is performed at a high pressure (1,000 kgf/cm$^2$).

Specifically, in the case where the regular pressure bonding was performed at a pressure of 1,000 kgf/cm$^2$, only Sample 6 with a firing temperature of 885° C. was rated as a non-defective product. Meanwhile, in the case where the regular pressure bonding was performed at a pressure of 400 kgf/cm$^2$, Sample 13 to Sample 15 with firing temperatures of 885° C. or higher and 895° C. or lower were rated as non-defective products. In the case where the regular pressure bonding was not performed, Sample 21 to Sample 24 with firing temperatures of 890° C. or higher and 905° C. or lower were rated as non-defective products. As described above, in the case where the regular pressure bonding was not performed or the regular pressure bonding was performed at a low pressure, the temperature condition for obtaining the electronic component 10 exhibiting a pore area ratio P1 of about 9.0% or more and 20.0% or less and, in addition, a pore area ratio P2 of about 0.7% or more and 8.0% or less was mild compared with the case where the regular pressure bonding was performed at a high pressure. The reason will be described below.

Regarding the electronic component 10, in order to enhance the strength of the multilayer body 12 while the internal stress is relaxed, it is preferable that the pore area ratio P1 be high and the pore area ratio P2 be low. That is, the difference between the pore area ratio P1 and the pore area ratio P2 is preferably large (for example, about 4% or more).

However, in the method for manufacturing the electronic component, if the mother multilayer body is subjected to the regular pressure bonding at a high pressure of about 1,000 kgf/cm$^2$, the density of the material forming the ceramic green sheet of the side gap A1 increases due to the regular pressure bonding. Consequently, the difference between the density of the material forming the ceramic green sheet of the side gap A1 and the density of the material forming the ceramic green sheet of the interlayer portion A2 is reduced. As a result, the difference between the pore area ratio P1 of the side gap A1 and the pore area ratio P2 of the interlayer portion A2 is reduced. Therefore, as shown in Table 1, the firing temperature, at which the electronic component 10 exhibiting a pore area ratio P1 of about 9.0% or more and 20.0% or less and, in addition, a pore area ratio P2 of about 0.7% or more and 8.0% or less can be obtained, is only about 885° C. As described above, if the regular pressure bonding is performed at a high pressure, it is difficult to obtain the electronic component 10 exhibiting desired pore area ratios P1 and P2 unless the firing temperature is controlled strictly.

Meanwhile, in the method for manufacturing the electronic component 10, the unfired mother multilayer body is not subjected to the regular pressure bonding or the mother multilayer body is subjected to the regular pressure bonding at a low pressure of 400 kgf/cm$^2$ or less. Consequently, the density of the material forming the ceramic green sheet of the side gap A1 is lower than the density of the material forming the ceramic green sheet of the interlayer portion A2. As a result, the pore area ratio P1 of the side gap A1 increases and the pore area ratio P2 of the interlayer portion A2 is reduced. That is, the difference between the pore area ratio P1 and the pore area ratio P2 increases. Therefore, as shown in Table 2 and Table 3, the firing temperature, at which the electronic component 10 exhibiting a pore area ratio P1 of about 9.0% or more and 20.0% or less and, in addition, a pore area ratio P2 of about 0.7% or more and 8.0% or less can be obtained, is 885° C. or higher and 895° C. or lower, or 880° C. or higher and 905° C. or lower. That is, the range of the firing temperature is broadened. As described above, in the case where the regular pressure bonding is not performed or the regular pressure bonding is performed at a low pressure, the electronic component 10 exhibiting desired pore area ratios P1 and P2 can be obtained without strictly controlling the firing temperature.

The pore area ratios P1 and P2 fluctuate because of various processing variations, e.g., lot-to-lot variations of the material, variations in grinding, and variations in firing. Therefore, in the case where the allowable range of the firing temperature is broadened, even when there are processing variations, the electronic component 10 exhibiting desired pore area ratios P1 and P2 can be obtained easily.

First Modified Example

An electronic component 10*a* according to a first modified example of the present disclosure will be described below. The electronic component 10*a* is different from the electronic component 10 in the materials for the coil conductor layers 18*a* to 18*h* and the via hole conductors v1 to v9.

Specifically, the coil conductor layers 18*a* to 18*h* and the via hole conductors v1 to v9 are produced from an electrically conductive paste (material) containing $Al_2O_3$ (an example of metal oxides) and containing Ag as a primary component. That is, the coil conductor layers 18*a* to 18*h* contain $Al_2O_3$ (an example of metal oxides). In this regard, the coil conductor layers 18*a* to 18*h* may contain a metal oxide other than $Al_2O_3$.The structure of the electronic component 10*a* is the same as the structure of the electronic component 10 and, therefore, explanations will not be provided.

The electronic component 10*a* can have the same operations and advantages as those of the electronic component 10.

When the material forming the coil conductor layers 18*a* to 18*h* and the via hole conductors v1 to v9 contains a metal oxide, so that the shrinkage start temperature in firing of the coil conductor layers 18*a* to 18*h* and the via hole conductors v1 to v9 increases. Consequently, the shrinkage start temperature of the coil conductor layers 18*a* to 18*h* and the via hole conductors v1 to v9 gets close to the shrinkage start temperature of the insulator layers 16*a* to 16*o*. As a result, hindrance to sintering of the insulator layers 16*a* to 16*o* by shrinkage of the coil conductor layers 18*a* to 18*h* and the via hole conductors v1 to v9 prior to shrinkage of the insulator layers 16*a* to 16*o* is suppressed. Therefore, occurrences of variations in the pore area ratio of the insulator layers 16*a* to 16*o* are suppressed, and variations in the strength of the multilayer body 12 are reduced. As a result, the value of the flexural strength at the failure probability=1% in the Weibull plot increases.

In order to examine the effects exerted by the electronic component 10*a*, the present inventors conducted the experiments described below. The present inventors prepared 30 each of Sample 28 to Sample 30. Regarding Sample 28 to Sample 30, only temporary pressure bonding was performed and the regular pressure bonding was not performed. The pressure of the temporary pressure bonding was specified as 100 kgf/cm$^2$. In Sample 28 to Sample 30, the proportion of $Al_2O_3$ mixed into the electrically conductive paste was changed. The firing temperature in each case was specified as 890° C.

The sizes of Sample 28 to Sample 30 were as described below.

Length in the lateral direction: 0.6 mm

Length in the forward or backward direction: 0.3 mm

Length in the vertical direction: 0.3 mm

The number of turns of the coil L in Sample 28 to Sample 30 was 30 turns. The target value of the impedance characteristics at 100 MHz was set at 1,200Ω (tolerance of ±10%).

Regarding Sample 28 to Sample 30 above, the pore area ratio P1 of the side gap A1 and the pore area ratio P2 of the interlayer portion A2 were measured. The flexural strengths of Sample 28 to Sample 30 were measured. In addition, Sample 28 to Sample 30 were subjected to the first bending test and a second bending test.

Second Bending Test

Each of 30 samples was mounted on a glass epoxy substrate having a substrate thickness of 0.8 mm. The center portion of the back surface of the resulting substrate was pushed toward the surface direction by a push rod so as to bend the substrate by 3.0 mm and the resulting state was held for 30 seconds.

Table 4 shows the experimental results.

TABLE 4

| | Sample | | |
|---|---|---|---|
| | 28 | 29 | 30 |
| Proportion of metal oxide | none | $Al_2O_3$ 0.05 wt % | $Al_2O_3$ 0.1 wt % |
| Inner electrode paste shrinkage start temperature | 400 | 680 | 780 |
| Pore area ratio P2 (%) | 7.7 | 7.9 | 7.8 |
| Pore area ratio P1 (%) | 16.3 | 16.6 | 16.3 |
| Flexural strength (N) | 4.0 | 5.6 | 5.9 |
| First bending test | ○ | ○ | ○ |
| Second bending test | X | ○ | ○ |

As is clear from Table 4, the flexural strength of each of Sample 29 and Sample 30, in which the electrically conductive paste containing $Al_2O_3$ was used, was higher than the flexural strength of Sample 28, in which the electrically conductive paste not containing $Al_2O_3$ was used. Sample 28, in which the electrically conductive paste not containing $Al_2O_3$ was used, was rated as a non-defective product on the basis of the first bending test and was rated as a defective product on the basis of the second bending test. On the other hand, each of Sample 29 and Sample 30, in which the electrically conductive paste containing $Al_2O_3$ was used, was rated as a non-defective product on the basis of both the first bending test and the second bending test. Consequently, it was found that the strength of the multilayer body 12 was enhanced because the coil conductor layers 18*a* to 18*h* contained $Al_2O_3$ (an example of metal oxides). In this regard, in the electronic component 10*a* according to the present modified example, aluminum oxide ($Al_2O_3$) was used as the metal oxide, although the same effects were obtained by the metal oxides such as zinc oxide, tin oxide, nickel oxide, copper oxide, iron oxide, and calcium oxide.

Second Modified Example

An electronic component 10*b* according to a second modified example of the present disclosure will be described below. The electronic component 10*b* is different from the electronic component 10 in that the multilayer body 12 is impregnated with an epoxy resin and the epoxy resin is cured before the underlying electrodes are subjected to Ni plating and Sn plating. Consequently, pores in the multilayer body 12 of the electronic component 10*b* are filled with the epoxy resin. In this regard, resins other than the epoxy resin may be used. The structure of the electronic component 10*b* is the same as the structure of the electronic component 10 and, therefore, explanations will not be provided.

The electronic component 10*b* can have the same operations and advantages as those of the electronic component 10. In addition, in the electronic component 10*b*, pores are filled with the epoxy resin, so that the strength of the multilayer body 12 is enhanced. Even when the pores are filled with the epoxy resin, reduction in the value of the impedance characteristics can be suppressed.

In order to examine the effects exerted by the electronic component 10*b*, the present inventors conducted the experiments described below. The present inventors prepared 30 each of Sample 31 to Sample 33. Sample 31 to Sample 33 were samples corresponding to Samples 3, 12, and 21, respectively, where each multilayer body 12 of the Sample 31 to Sample 33 was impregnated with the epoxy resin and the epoxy resin was cured.

Regarding Sample 31 to Sample 33 above, the pore area ratio P1 of the side gap A1 and the pore area ratio P2 of the interlayer portion A2 were measured. The impedance characteristics at 100 MHz of Sample 31 to Sample 33 were measured. The flexural strengths of Sample 31 to Sample 33 were measured. In addition, Sample 31 to Sample 33 were subjected to the first bending test and a third bending test.

Table 5 shows the experimental results.

Third Bending Test

Each of 30 samples was mounted on a glass epoxy substrate having a substrate thickness of 1.6 mm. The center portion of the back surface of the resulting substrate was pushed toward the surface direction by a push rod so as to bend the substrate by 2.0 mm and the resulting state was held for 30 seconds.

TABLE 5

| Sample | 3 | 12 | 21 | 31 | 32 | 33 |
|---|---|---|---|---|---|---|
| Firing temperature (° C.) | 870 | 880 | 890 | 870 | 880 | 890 |
| Pore area ratio P2 (%) | 14.3 | 10.5 | 7.7 | 14.3 | 10.5 | 7.7 |
| Pore area ratio P1 (%) | 16.0 | 15.9 | 16.3 | 16.0 | 15.9 | 16.3 |
| Impedance characteristics Z at 100 MHz (Ω) | 1161 | 1178 | 1203 | 928 | 1045 | 1155 |
| Evaluation of impedance characteristics | ○ | ○ | ○ | x | x | ○ |
| Flexural strength (N) | 1.9 | 2.8 | 4.0 | 6.5 | 6.8 | 6.9 |
| First bending test | x | x | ○ | ○ | ○ | ○ |
| Third bending test | x | x | x | ○ | ○ | ○ |

As is clear from Table 5, the flexural strength of each of Sample 31 to Sample 33, in which the multilayer body 12 was filled with the epoxy resin, was higher than the flexural strength of each of Samples 3, 12, and 21, in which the multilayer body 12 was not filled with the epoxy resin. Sample 21, in which the multilayer body 12 was not filled with the epoxy resin, was rated as a non-defective product on the basis of the first bending test and was rated as a defective product on the basis of the third bending test. On the other hand, Sample 31, in which the multilayer body 12 was filled with the epoxy resin, was rated as a non-defective product on the basis of both the first bending test and the third bending test. Consequently, it was found that the strength of the multilayer body 12 was enhanced by the multilayer body 12 being filled with the epoxy resin.

Regarding each of Samples 31 and 32 corresponding to Samples 3 and 12, respectively, in which the multilayer body 12 was filled with the epoxy resin, the pore area ratio P2 of the interlayer portion A2 was out of the range of 0.7% or more and 8.0% or less, so that the values of the impedance characteristics were reduced by about 10% or more.

On the other hand, regarding Sample 21, the pore area ratio P2 of the interlayer portion A2 was within the range of 0.7% or more and 8.0% or less, so that reduction in the impedance was suppressed to about 4% or less even when the multilayer body 12 was filled with the epoxy resin as in Sample 33.

The value of the impedance characteristics was not reduced because the pore area ratio P2 of the interlayer portion A2 was 0.7% or more and 8.0% or less and was small, so that the resin did not impregnate up to the interface between the coil conductor layer and the insulator layer around the coil conductor layer easily and the state, in which the coupling between the coil conductor layer and the insulator layer around the coil conductor layer at the interface was cut, was able to be maintained.

Third Modified Example

Figure 6:
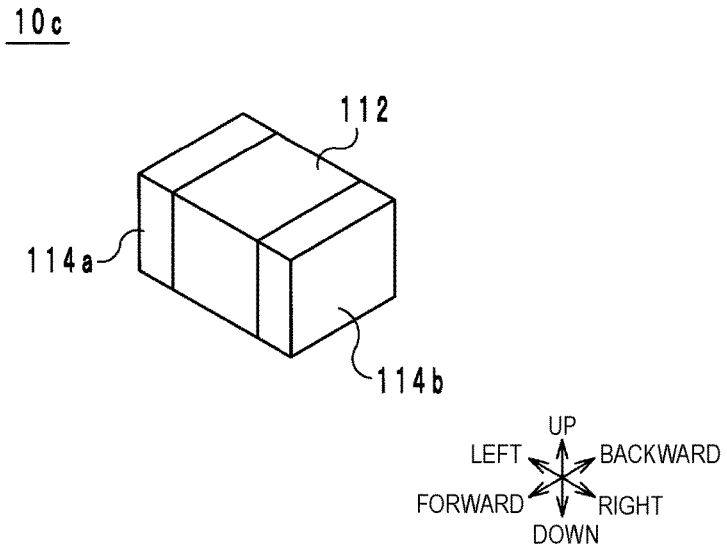
FIG. 6 shows an outside perspective view of an electronic component according to a third modified example.
Figure 7:
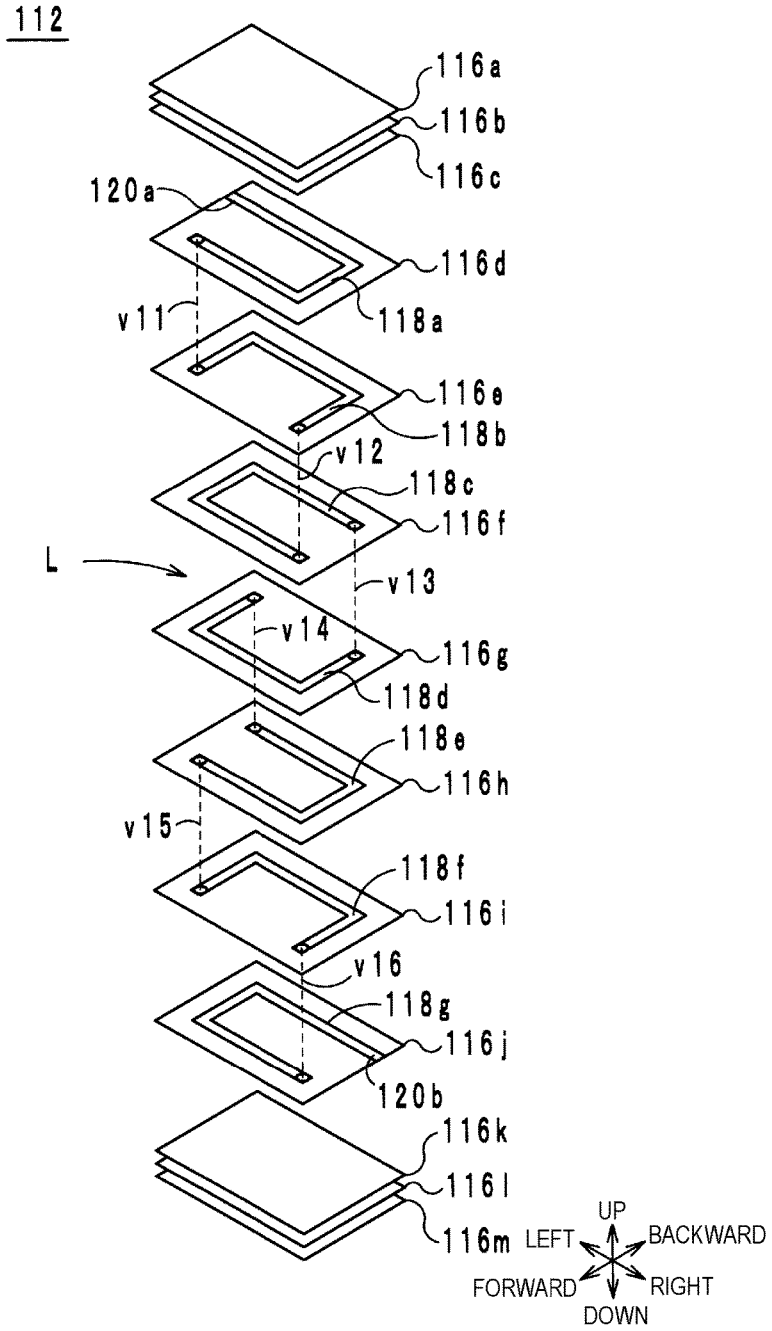
FIG. 7 shows an exploded perspective view of a multilayer body of an electronic component.

An electronic component according to a third modified example of the present disclosure will be described below with reference to the drawings. FIG. 6 shows an outside perspective view of an electronic component 10*c* according to the third modified example. FIG. 7 shows an exploded perspective view of a multilayer body 112 of the electronic component 10*c*. Hereafter the stacking direction of the electronic component 10*c* is defined as the vertical direction and, when the electronic component 10*c* is viewed from above, the direction of extension of a long side is defined as a lateral direction, and the direction of extension of a short side is defined as the forward or backward direction. The vertical direction, the forward or backward direction, and the lateral direction are orthogonal to each other.

The difference point between the electronic component 10 and the electronic component 10*c* is the positional relationship between outer electrodes 114*a* and 114*b* and a coil L. Specifically, in the electronic component 10, the coil L has a substantially spiral shape that spirals in the lateral direction and has a so-called horizontal winding structure. In addition, the outer electrodes 14*a* and 14*b* are disposed on both sides in the lateral direction of the multilayer body 12.

On the other hand, in the electronic component 10*c*, the coil L has a substantially spiral shape that spirals in the vertical direction and has a so-called horizontal winding structure, as shown in FIG. 6 and FIG. 7. The outer electrodes 114*a* and 114*b* are disposed on both sides in the lateral direction of the multilayer body 112. The electronic component 10*c* will be described below centering on such a difference point.

As shown in FIG. 6 and FIG. 7, the electronic component 10*c* includes the multilayer body 112, the coil L, the outer electrodes 114*a* and 114*b*, and connection conductor layers 120*a* and 120*b*. The multilayer body 112 has a substantially rectangular parallelepiped shape and has a configuration, in which insulator layers 116*a* to 116*m* are stacked in that order from top to bottom, as shown in FIG. 7. The insulator layers 116*a* to 116*m* are the same as the insulator layers 16*a* to 16*o* and, therefore, further explanations will not be provided.

The outer electrodes 114*a* and 114*b* are disposed on both side surfaces in the lateral direction orthogonal to the stacking direction. The other configurations of the outer electrodes 114*a* and 114*b* are the same as the configurations of the outer electrodes 14*a* and 14*b*. Therefore, explanations will not be provided.

As shown in FIG. 7, the coil L includes coil conductor layers 118*a* to 118*g* and via hole conductors v11 to v16. The coil conductor layers 118*a* to 118*g* are disposed on the surfaces of the insulator layers 116*d* to 116*j*, respectively. The coil conductor layers 118*a* to 118*g* are different from the coil conductor layers 18*a* to 18*h* in the point that the shape is a substantially rectangular frame, where one side is cut away. The other configurations of the coil conductor layers 118*a* to 118*g* are the same as the configurations of the coil conductor layers 18*a* to 18*h*. Therefore, explanations will not be provided. Hereafter, when viewed from above, the end portions on the upstream side in the clockwise direction of the coil conductor layers 118*a* to 118*g* are referred to as upstream ends and the end portions on the downstream side in the clockwise direction of the coil conductor layers 118*a* to 118*g* are referred to as downstream ends.

The via hole conductor vii penetrates the insulator layers 116*d* in the vertical direction and connects the downstream end of the coil conductor layer 118*a* to the upstream end of the coil conductor layer 118*b*. The via hole conductor v12 penetrates the insulator layer 116*e* in the vertical direction and connects the downstream end of the coil conductor layer 118*b* to the upstream end of the coil conductor layer 118*c*. The via hole conductor v13 penetrates the insulator layer 116*f* in the vertical direction and connects the downstream end of the coil conductor layer 118*c* to the upstream end of the coil conductor layer 118*d*. The via hole conductor v14 penetrates the insulator layer 116*g* in the vertical direction and connects the downstream end of the coil conductor layer 118*d* to the upstream end of the coil conductor layer 118*e*. The via hole conductor v15 penetrates the insulator layer 116*h* in the vertical direction and connects the downstream end of the coil conductor layer 118*e* to the upstream end of the coil conductor layer 118*f*. The via hole conductor v16 penetrates the insulator layer 116*i* in the vertical direction and connects the downstream end of the coil conductor layer 118*f* to the upstream end of the coil conductor layer 118*g*.

The connection conductor layer 120*a* connects the upstream end of the coil conductor layer 118*a* to the outer electrode 114*a*. The connection conductor layer 120*b* connects the downstream end of the coil conductor layer 118*g* to the outer electrode 114*b*.

The coil conductor layers 118*a* to 118*g*, the connection conductor layers 120*a* and 120*b*, and the via hole conductors v11 to v16 are produced from, for example, an electrically conductive paste containing Ag as a primary component.

The above-described coil L has a substantially clockwise spiral shape, when viewed from above, and spirals from the upper side to the lower side.

In the electronic component 10*c*, the pore area ratio P1 of the side gap A1 is about 9.0% or more and 20.0% or less. The pore area ratio P2 of the interlayer portion A2 is about 0% or more and 8.0% or less and more preferably about 0.7% or more and 7.7% or less.

The method for manufacturing the electronic component 10*c* is the same as the method for manufacturing the electronic component 10 and, therefore, explanations will not be provided.

The thus configured electronic component 10*c* has the same operations and advantages as those of the electronic component 10.

In order to make the effects of the electronic component 10*c* more apparent, the present inventors conducted the experiments described below. The present inventors formed 30 each of Sample 34 to Sample 36. Sample 34 was subjected to temporary pressure bonding and regular pressure bonding. The pressure of the regular pressure bonding was specified as 1,000 kgf/cm$^2$. The pressure of the temporary pressure bonding was specified as 100 kgf/cm$^2$. Regarding Sample 34, the firing temperature was specified as 870° C. Sample 35 was subjected to the temporary pressure bonding and the regular pressure bonding. The pressure of the regular pressure bonding was specified as 400 kgf/cm$^2$. The pressure of the temporary pressure bonding was specified as 100 kgf/cm$^2$. Regarding Sample 35, the firing temperature was specified as 880° C. Sample 36 was subjected to only the temporary pressure bonding, and the regular pressure bonding was not performed. The pressure of the temporary pressure bonding was specified as 100 kgf/cm$^2$. Regarding Sample 36, the firing temperature was specified as 890° C.

The sizes of Sample 34 to Sample 36 were as described below.

Length in the lateral direction: 0.4 mm

Length in the forward or backward direction: 0.2 mm

Length in the vertical direction: 0.2 mm

The number of turns of the coil L in each of Sample 34 to Sample 36 was 30 turns. The target value of the impedance characteristics at 100 MHz was set at 120 Ω (tolerance of ±10%).

Regarding Sample 34 to Sample 36 above, the pore area ratio P1 of the side gap A1 and the pore area ratio P2 of the interlayer portion A2 were measured. The impedance characteristics at 100 MHz of Sample 34 to Sample 36 were measured. The flexural strengths of Sample 34 to Sample 36 were measured. In addition, Sample 34 to Sample 36 were subjected to the second bending test and the fourth bending test.

Table 6 shows the experimental results.

Fourth Bending Test

Each of 30 samples was mounted on a glass epoxy substrate having a substrate thickness of 1.6 mm. The center portion of the back surface of the resulting substrate was pushed toward the surface direction by a push rod so as to bend the substrate by 3.0 mm and the resulting state was held for 30 seconds.

TABLE 6

| | Sample | | |
|---|---|---|---|
| | 34 | 35 | 36 |
| Firing temperature (° C.) | 870 | 880 | 890 |
| Pore area ratio P2 (%) | 13.5 | 10.2 | 7.5 |
| Pore area ratio P1 (%) | 15.5 | 15.6 | 15.8 |
| Impedance characteristics Z at 100 MHz | 120 | 122 | 123 |
| Flexural strength (N) | 2.7 | 3.4 | 4.5 |
| Second bending test | ○ | ○ | ○ |
| Fourth bending test | X | X | ○ |

As is clear from Table 6, regarding Sample 34 to Sample 36 as well, in the case where the pore area ratios P1 were 9.0% or more and 20.0% or less and the pore area ratios P2 were 0.7% or more and 8.0% or less, the strength of the multilayer body 12 was able to be enhanced while the internal stress was relaxed.

The electronic component according to the present disclosure and the method for manufacturing the same are not limited to the above-described electronic components 10 and 10*a* to 10*c* and the method for manufacturing the same and can be modified within the scope of the gist thereof.

Also, the configuration of each of the electronic components 10 and 10*a* to 10*c* and the method for manufacturing the same may be combined appropriately.

Meanwhile, in the method for manufacturing the electronic components 10 and 10*a* to 10*c*, the internal stress is relaxed by dipping the multilayer body 12 into the acidic solution before the underlying electrode is subjected to the Ni plating and the Sn plating. However, the internal stress may be relaxed by dipping the multilayer body 12 into the acidic plating solution for forming the outer electrodes 14*a*, 14*b*, 114*a*, and 114*b* (more precisely, for subjecting the underlying electrode to the Ni plating and the Sn plating).

As described above, the present disclosure is useful for electronic components and methods for manufacturing the same and is excellent, in particular, because the strength of the multilayer body can be enhanced while the internal stress is relaxed.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a multilayer body having a configuration, in which a plurality of insulator layers containing ferrite ceramic are stacked in a stacking direction; and a coil having a configuration, in which a plurality of coil conductor layers containing Ag and being disposed on the insulator layers are connected to at least one via hole conductor penetrating the insulator layer in the stacking direction, and having a spiral shape spiraling in the stacking direction, wherein a first pore area ratio of a side gap interposed between an outer circumferential edge of an annular track formed by stacking the plurality of coil conductor layers and an outer edge of the multilayer body, when viewed in the stacking direction, is 9.0% or more and 20.0% or less, and a second pore area ratio of a portion interposed between two coil conductor layers in the stacking direction is 8.0% or less, wherein the coil conductor layer is formed by an electrically conductive paste containing a metal oxide such that the metal oxide is present inside of the coil conductor.

2. The electronic component according to claim 1, wherein a difference between the first pore area ratio and the second pore area ratio is 4.0% or more.

3. The electronic component according to claim 1, wherein the insulator layer contains NiCuZn ferrite ceramic.

4. The electronic component according to claim 1, wherein the metal oxide contains at least one of aluminum oxide, zinc oxide, tin oxide, nickel oxide, copper oxide, iron oxide, and calcium oxide.

5. The electronic component according to claim 1, wherein pores disposed in the multilayer body are filled with a resin.

6. The electronic component according to claim 1, further comprising:

a first outer electrode disposed on one surface in the stacking direction of the multilayer body; and a second outer electrode disposed on the other surface in the stacking direction of the multilayer body.

7. The electronic component according to claim 1, further comprising:

a first outer electrode disposed on one surface in a direction orthogonal to the stacking direction of the multilayer body; and a second outer electrode disposed on the other surface in a direction orthogonal to the stacking direction of the multilayer body.

8. An electronic component comprising:

a multilayer body having a configuration, in which a plurality of insulator layers containing ferrite ceramic are stacked in a stacking direction; and a coil having a configuration, in which a plurality of coil conductor layers containing Ag and being disposed on the insulator layers are connected to at least one via hole conductor penetrating the insulator layer in the stacking direction, and having a spiral shape spiraling in the stacking direction, wherein a first pore area ratio of a side gap interposed between an outer circumferential edge of an annular track formed by stacking the plurality of coil conductor layers and an outer edge of the multilayer body, when viewed in the stacking direction, is 9.0% or more and 20.0% or less, and a second pore area ratio of a portion interposed between two coil conductor layers in the stacking direction is 8.0% or less, wherein the second pore area ratio is less than the first pore area ratio.

9. The electronic component according to claim 8, wherein a difference between the first pore area ratio and the second pore area ratio is 4.0% or more.

10. The electronic component according to claim 8, wherein the insulator layer contains NiCuZn ferrite ceramic.

11. The electronic component according to claim 8, wherein the coil conductor layer contains a metal oxide.

12. The electronic component according to claim 11, wherein the metal oxide contains at least one of aluminum oxide, zinc oxide, tin oxide, nickel oxide, copper oxide, iron oxide, and calcium oxide.

13. The electronic component according to claim 8, wherein pores disposed in the multilayer body are filled with a resin.

14. The electronic component according to claim 8, further comprising:

a first outer electrode disposed on one surface in the stacking direction of the multilayer body; and a second outer electrode disposed on the other surface in the stacking direction of the multilayer body.

15. The electronic component according to claim 8, further comprising:

a first outer electrode disposed on one surface in a direction orthogonal to the stacking direction of the multilayer body; and a second outer electrode disposed on the other surface in a direction orthogonal to the stacking direction of the multilayer body.

* * * * *